US005380054A

United States Patent [19]

Galvis

[11] Patent Number: 5,380,054

[45] Date of Patent: Jan. 10, 1995

[54] HANDHELD DEVICE FOR PICKING UP OBJECTS

[76] Inventor: Misael Galvis, 4062 Ashford St., San Diego, Calif. 92111

[21] Appl. No.: 220,750

[22] Filed: Mar. 31, 1994

[51] Int. Cl.[6] ..... A01K 29/00; E01H 1/12

[52] U.S. Cl. ..... 294/1.4; 294/19.1; 294/116

[58] Field of Search ..... 294/1.3, 1.4, 19.1, 294/19.2, 50.8, 55, 110.1, 115, 116

[56] References Cited

U.S. PATENT DOCUMENTS

| | | | |
|---|---|---|---|
| 182,367 | 9/1876 | Jones | 294/50.8 X |
| 465,222 | 12/1891 | Ulbricht | 234/19.1 |
| 868,690 | 10/1907 | O'Kane | 294/115 |
| 3,841,686 | 10/1974 | Gallo et al. | 294/1.4 |
| 4,225,174 | 9/1980 | Hennessy et al. | 294/1.4 |
| 4,669,769 | 6/1987 | Polder | 294/19.1 |
| 4,962,957 | 10/1990 | Traber | 294/19.1 |
| 5,154,465 | 10/1992 | Pakosh | 294/19.1 X |

*Primary Examiner*—Johnny D. Cherry

*Attorney, Agent, or Firm*—Charles C. Logan, II

[57] ABSTRACT

A handheld device for picking up objects and its major components are a handgrip assembly, an elongated tubular member, a combination plunger and double bellcrank assembly, and structure connected to the front end of the bellcranks for picking up objects. The structure for picking up objects can be clamshell buckets, gripping jaws, or other desired structure. The combination plunger and double bell crank assembly has an elongated plunger having a head portion on its front end that reciprocates back and forth between the respective left and right side bellcrank members. Cam surfaces on the head portion contact distinctive surfaces of the recesses formed in the bellcrank member causing the structure for picking up objects to open their arms upon travel of the plunger and close their arms upon its return travel. The handgrip assembly has structure for locking the trigger in its rearward pulled position so that it is not necessary for the user to continually squeeze the trigger while holding the object that has been picked up.

8 Claims, 2 Drawing Sheets 12
38
10
18
80
80
14
16
24
25

24
12
14
84
18
38
16
85

40
31
36
20
38
27
34
30
44
14
46
32
41
21
22
28
47
48
24
25

80
82
82
80

18
85
52
62
81
80
59
7
86
87
46
14
60
7
57
49
56
80
81
51
62

14
86
87
46
59

85
62
80
82
46
14
50
51
49
62
80
82

HANDHELD DEVICE FOR PICKING UP OBJECTS

BACKGROUND OF THE INVENTION

The invention generally relates to hand operated devices for picking up objects and more specifically it relates to a device for removing animal feces.

Scoops and containers for retrieving and disposing of animal wastes may take a permanent and reusable form or a disposable form. Permanent and reusable scoops are primarily utilized by home owners on their residential properties. Disposable scoops and containers are utilized on city and park lands where city ordinances require the collection and disposal of animal wastes.

Numerous collecting devices have been provided in the prior art that are adapted to pick up droppings of dogs, cats and the like. For example, U.S. Pat. Nos. 4,148,513; 4,200,321; 4,225,175; 4,741,566; 4,747,633; 4,836,594; and 5,064,233 are all illustrative of such prior art.

Occasions also occur when it is necessary to retrieve articles or pick up items that are on the ground or located at other positions which are hard for some individuals to do. Such a device may be necessary for picking up trash or other litter on the ground or inaccessible locations.

It is an object of the invention to provide a novel handheld device for picking up objects that can be used for picking up animal feces without the user having to touch the same.

It is also an object of the invention to provide a novel hand held device for picking up objects that automatically locks its clamshell buckets together once the object has been removed from the ground.

It is another object of the invention to provide a novel handheld device for picking up objects that utilizes a unique combination plunger and double bellcrank assembly.

It is an additional object of the invention to provide a novel hand held device for picking up objects that is economical to manufacture and market.

It is a further object of the invention to provide a novel handheld device for picking up objects that can be easily operated by both youngsters and adults.

SUMMARY OF THE INVENTION

The novel handheld device for picking up objects has four primary components. These are the handgrip assembly, the elongated tubular member, the combination plunger and double bellcrank assembly and the structure that would be connected to the front ends of the bellcrank member for picking up objects. The structure for picking up objects could take the form of a pair of clamshell buckets, a pair of jaw members, or other desirable structure.

The handgrip assembly would normally be formed from a block housing having a cavity formed in its bottom. The top end of a trigger member would be pivotally mounted within the block housing. Structure is also assembled in the block housing that allows the trigger to be automatically locked in its rear position once the object has been picked up or captured within the clam shell buckets.

The combination plunger and double bellcrank assembly has an elongated plunger having a head portion formed at its front end. Positioned along its lateral sides is a left side bellcrank and a right side bellcrank. The head portion has cam surfaces that interplay with recess surfaces formed in the respective inner surfaces of the bellcranks. A top cover plate and a bottom cover plate form a sandwich type structure around the head portion of the plunger and the respective bellcranks. Pivot pins secure the bellcranks to the respective top and bottom plates and allow the bellplates to rotate when the cam surfaces of the plunger head contact the recess surfaces of the bellcrank both during the forward and rearward travel of the plunger to provide positive action in both directions.

In the embodiment having clamshell buckets secured to the front edge of the bellcranks, the buckets would be rotated to an open position as the plunger travels forwardly and the buckets would be rotated to their closed position when the plunger travels rearwardly. The elongated rod passing through the center of the tubular member has its one end detachably secured to the trigger member and its other end detachably secured to the rear end of the plunger. A spring surrounding the rod member and abutting the rear end of the plunger has its rearward travel restricted by a transversely extending wall. Thus, when the trigger member is pulled rearwardly, this spring is compressed and maintained in this state when the structure in the handgrip assembly locks the trigger in its rearward position. The release of the trigger member to travel forwardly allows the compressed spring to drive the plunger forwardly and open the clamshell buckets.

The block housing of the handgrip assembly has a bore formed in its rear wall and it receives a piston having a cavity in its forward portion that has an opening along its bottom edge. A rearwardly extending flange along the bottom edge in the front of the piston performs a function to be described later. The front end of the piston presses against the rear end of a spring whose front end rests against a downwardly extending abutting boss. The trigger member has a transversely extending leg member that extends generally horizontally and rearwardly and from its rearward end a foot portion extends upwardly. The foot portion has a top cam surface and also a groove formed in its forward edge. When the trigger member is pulled rearwardly, the cam surface rides upwardly over the rearwardly extending flange of the piston causing the piston to travel forwardly. After it is traveled forwardly a predetermined distance, the cam surface clears the rear end of the rearwardly extending flange which drops into the groove formed between the cam surface and the horizontal leg member of the trigger member. Since the trigger member is connected to the rear end of the rod, the rod pulls the plunger rearwardly causing the buckets or jaw-like members to be closed toward each other. By pressing the piston inwardly a sufficient distance, the cam surface on the foot on the leg member of the trigger member will clear the rearwardly extending flange of the piston and allow the spring that had been compressed against the rear end of the plunger to drive it forwardly and thereby open the buckets or jaw members.

The handheld device for picking up objects is versatile and can be used for picking up different things such as solid animal excrements, small quantities of trash, leaves, loose soil, etc. The clamshell buckets are designed in such a way that they won't accumulate residue along their corners since the side walls are at a 20 degree angle which when opened work as a slide to facilitate unloading the contents of the bucket. There are teeth located at the bottom of the bucket and these are laterally offset from each other so that when solid excrements or any type of trash is picked up from grass, it won't damage the grass since the teeth act as a comb making a positive movement without damaging the grass and by this saving on expensive repairs to gardens. One can use plastic bags made especially for these buckets or any other plastic bag of the same size and made out of good material can be used. The bucket can also be formed without bottom teeth thereby making two flat surfaces that can be slid against each other on a hard surface such as concrete or asphalt.

DESCRIPTION OF THE PREFERRED EMBODIMENT

Figure 1:
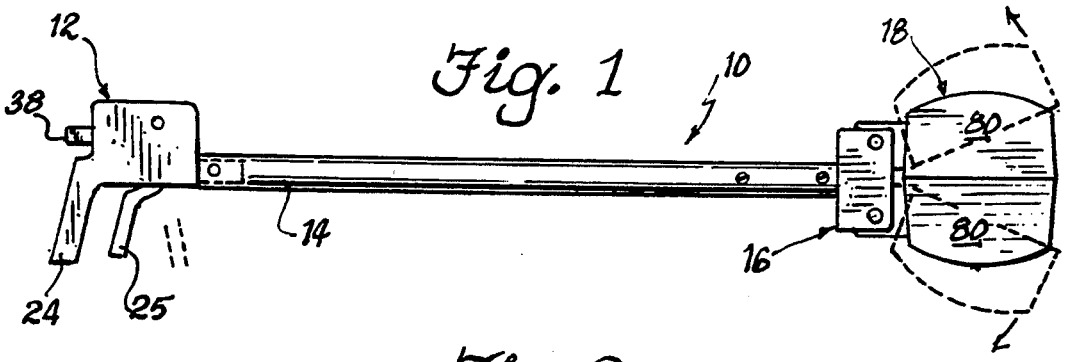
FIG. 1 is a right side elevation view of the novel handheld device for picking up objects.
Figure 2:
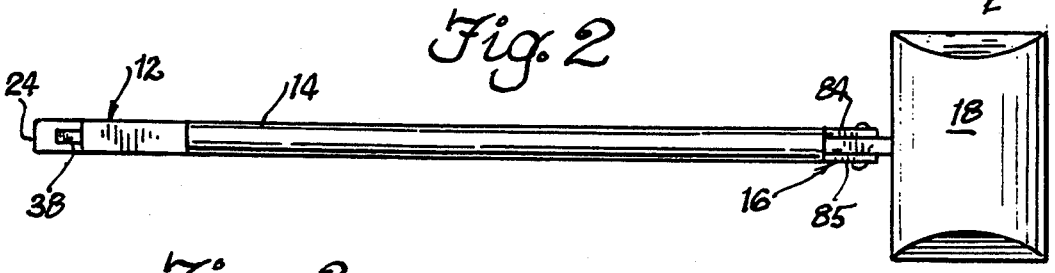
FIG. 2 is a top plan view of the novel handheld device for picking up objects.

The novel handheld device for picking up objects will now be described by referring to FIGS. 1–8 of the drawings. The handheld device is generally designated numeral 10. It has a hand grip assembly 12, an elongated tubular member 14, a combination plunger and double bellcrank assembly 16 and a clamshell bucket assembly 18.

Figure 3:
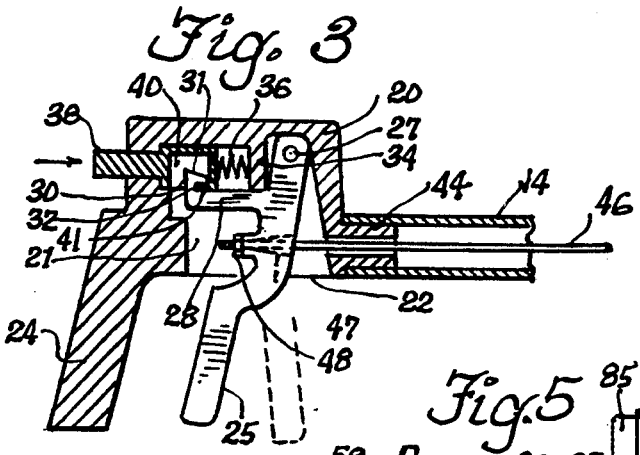
FIG. 3 is a vertical cross section view through the handgrip assembly.
Figure 4:
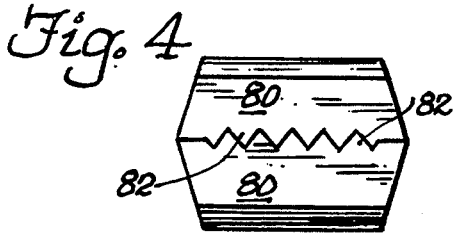
FIG. 4 is a front elevation view of the novel handheld device for picking up objects.

The handgrip assembly 12 structure and its manner of operation will be best understood by referring to FIGS. 1 and 3 of the drawings. Handgrip assembly 12 has a block-like housing 20 having a cavity 21 in its interior that opens to its bottom edge 22. A handgrip handle 24 extends downwardly from the rear end of block-like housing 20. A trigger member 25 has its top end pivotally secured within cavity 21 by a pin 27. A leg member 28 extends substantially horizontally from trigger member 25 and at its rear end it has a foot portion 30 extending upwardly that has a top cam surface 31 and a forward groove surface 32. A boss 34 extends downwardly within cavity 21 and provides a forward abutting surface for spring 36. A piston 38 has a front wall that abuts against the rear end of spring 36. A cavity 40 is formed in piston 38 and a flange 41 extends rearwardly from its front wall. A neck portion 44 extends forwardly from block housing 20 and telescopes within the rear end of tubular member 14.

Figure 5:
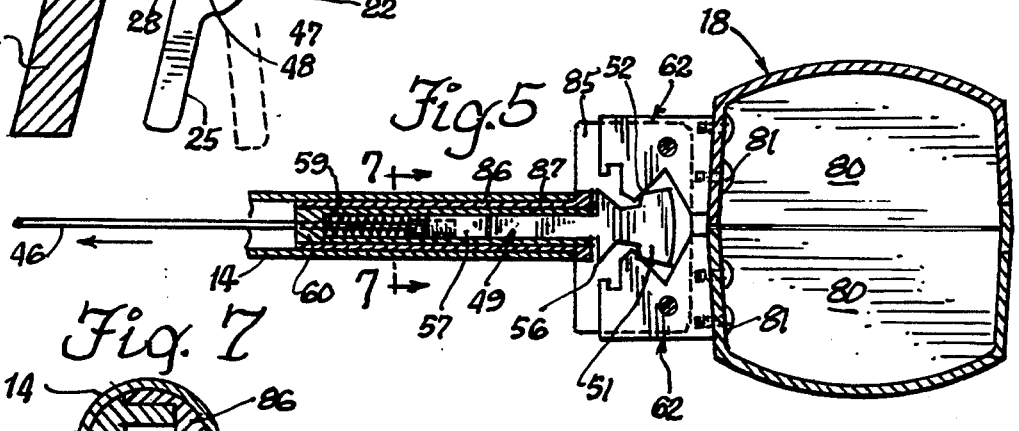
FIG. 5 is a vertical cross section view through the combination plunger and double bellcrank assembly showing the clamshell members in their closed position.
Figure 7:
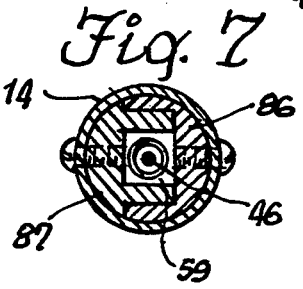
FIG. 7 is a cross sectional view taken along lines 7—7 of FIG. 5.
Figure 6:
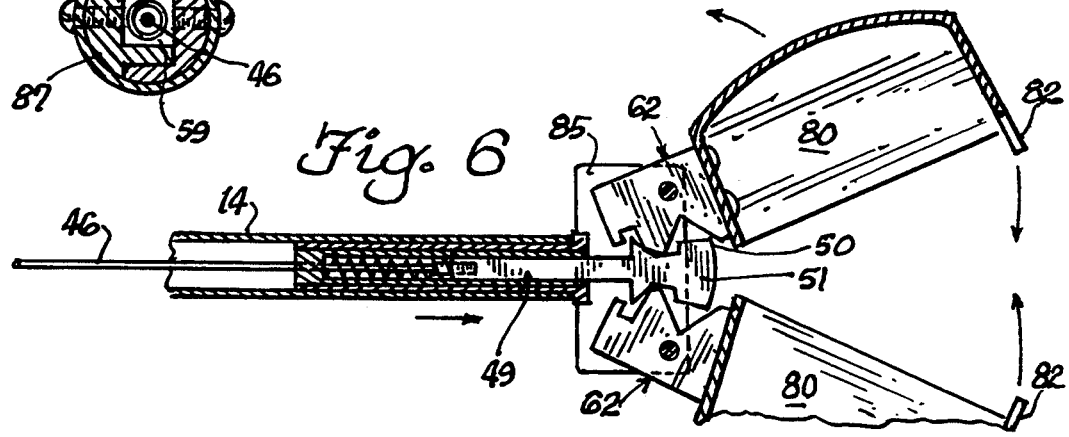
FIG. 6 is a vertical cross section view through the combination plunger and double bellcrank assembly showing the clamshell members in their open position.
Figure 8:
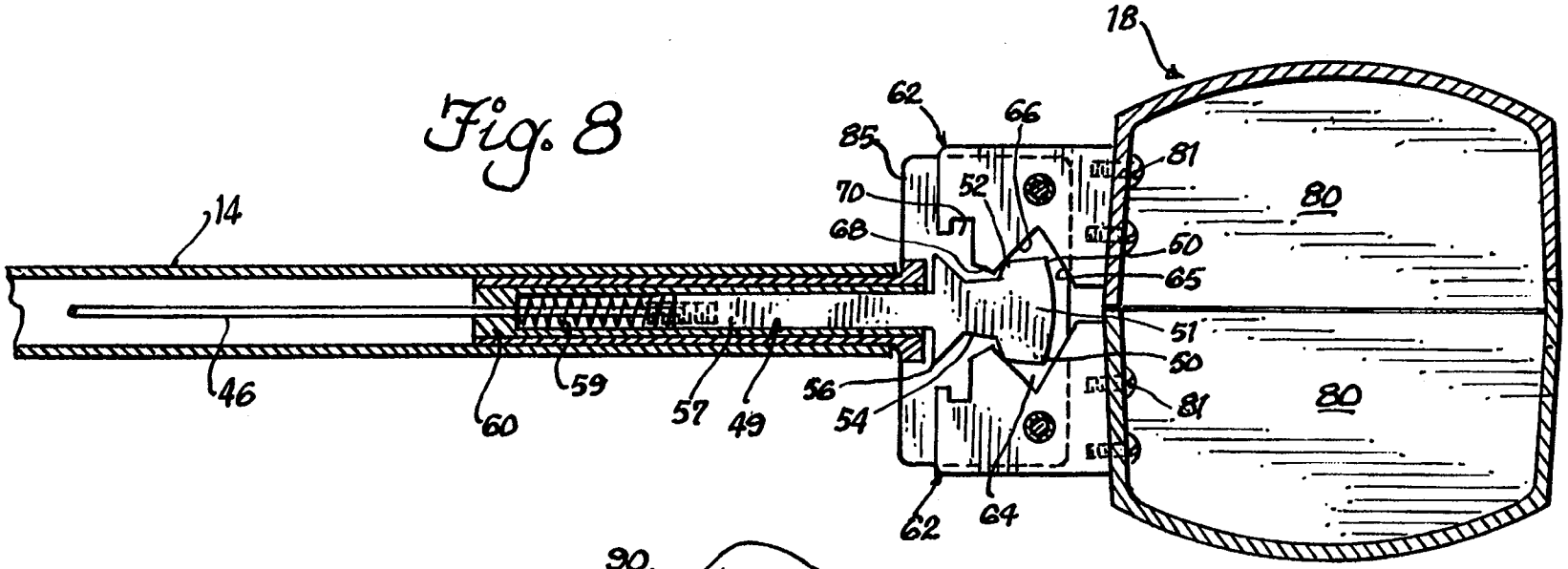
FIG. 8 is an enlarged vertical cross section view of the combination plunger and double bellcrank assembly showing the clamshell members in their closed position.

Referring to FIGS. 3 and 5, it will be seen that a rod 46 is threaded at both its front and rear ends and that its rear end extends through a bore hole 47 in trigger member 25 and is held in position by a locking nut 48. The front end of rod 46 is threaded into the rear end of plunger 49. Plunger 49 has a head portion 51 having cam surfaces 50 formed along its front surface at its opposite lateral edges. Traveling rearwardly along the lateral edges of head portion 51 there are second cam surfaces 52 followed by a recess 54 and outwardly extending protrusions 56. The rear end of shank portion 57 of plunger 49 threadably receives the front end of rod 46. A spring 59 surrounds rod member 46 and abuts against the rear end of shank portion 57 and against a transversely extending wall 60. Bellcrank members 62 have a recess 64 having cam contact surfaces 65 and 66. Following this are protrusions 68 and recesses 70. During forward travel of plunger 49, the respective cam surfaces 50 first contact surfaces 65 of recess 64. Continued travel of head portion 49 forwardly starts to open the clamshell bucket assembly 18 and after it is open a predetermined amount, the protrusions 56 contact the protrusions 68 thereby opening the clamshell bucket assembly to its full open position. When the travel of the plunger 49 is reversed, cam surfaces 52 press against surfaces 66 of recesses 64 causing the clamshell bucket assembly to close.

Clamshell bucket assembly 18 is formed of two clamshell bucket members 80 that are secured to the front end of bellcrank members 62 by screws 81. The front edge of the respective clamshell buckets have teeth 82. Top plate 84 and bottom plate 85 form a sandwich-like structure over the respective combination plunger and double bellcrank assembly. Top cover plate 84 has a shank portion 86 that extends into tubular sleeve 14. Likewise, bottom cover plate 85 has a shank portion 87 that telescopes into the front end of tubular sleeve 14.

Figure 9:
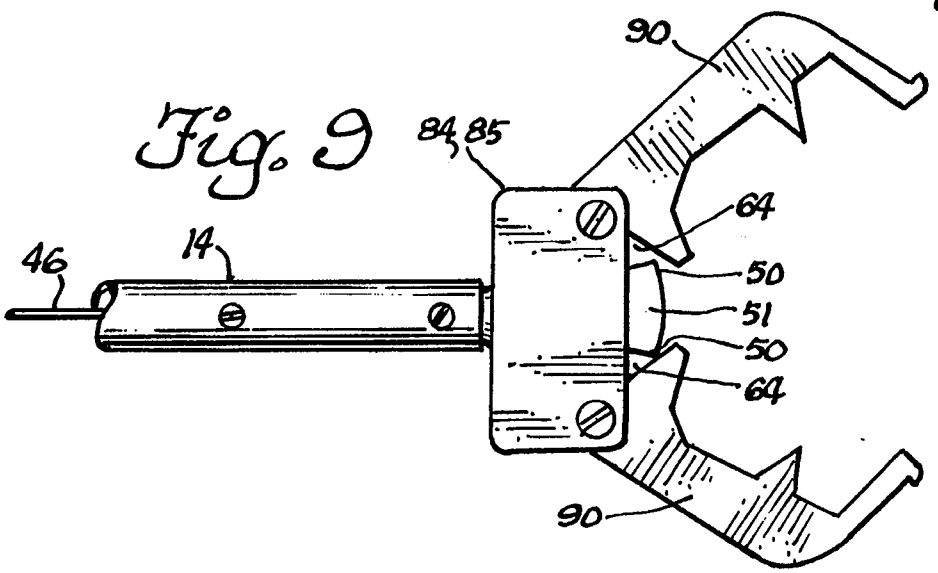
FIG. 9 is a right side elevation view of an alternative embodiment structure connected to the front end of the bellcrank members for picking up objects.

Alternative structure that may be secured to the front end of the bellcrank members for picking up objects is illustrated in FIG. 9. A pair of jaw-like gripping members 90 have the rear ends secured to the front end of the bellcrank members 62.

What is claimed is:

1. A handheld device for picking up objects comprising:

a handgrip assembly having a front end, a rear end, a left side, a right side and a bottom side, a handgrip handle extends downwardly from the rear end of said handgrip assembly, an elongated trigger member having a top end and a bottom end is secured to said handgrip assembly;

an elongated tubular member having a front end and a rear end;

means connecting the rear end of said tubular member to the front end of said handgrip assembly;

a combination plunger and double bellcrank assembly comprising: an elongated plunger having a front end and a rear end, a head portion formed at said front end, a shank portion extends rearwardly from said head portion; said head portion having a left side having a first cam surface formed adjacent its front end and a first protrusion formed adjacent its rear end and a principal recess formed intermediate said first cam surface and said protrusion; said head portion having a right side having a first cam surface formed adjacent its front end and a first protrusion formed adjacent its rear end and a principal recess formed intermediate said first cam surface and said protrusion; a left side bellcrank having a front end, a rear end, a left side and a right side, said right side having in sequence from front to rear a primary recess, a protruding cam surface and a secondary recess; a right side bellcrank having a front end, a rear end, a left side and a right side, said left side having in sequence from front to rear a primary recess, a protruding cam surface and a secondary recess;

means connecting the front end of said tubular member to said combination plunger and double bellcrank assembly;

an elongated rod having a front end and a rear end; means for detachably securing said rear end to said trigger member and means for detachably securing the front end of said rod to the rear end of said plunger so that when said trigger is pulled rearwardly the plunger will also be pulled rearwardly and cause the front ends of said bellcranks to pivot toward each other.

2. A handheld device for picking up objects as recited in claim 1 further comprising means connected to the front end of said bellcranks for picking up objects.

3. A handheld device for picking up objects as recited in claim 2 wherein said means for picking up objects comprises a pair of clamshell buckets.

4. A handheld device for picking up objects as recited in claim 2 wherein said means for picking up objects comprises a pair of jaw-like gripping members.

5. A handheld device for picking up objects as recited in claim 2 further comprising locking means for locking said trigger in its rearward pulled position.

6. A handheld device for picking up objects as recited in claim 5 further comprising means for automatically opening said means for picking up objects immediately upon the locking means for said trigger being released.

7. A handheld device for picking up objects as recited in claim 1 wherein said handgrip assembly has a block-like housing having a cavity in its bottom for receiving the top end of said trigger.

8. A handheld device for picking up objects as recited in claim 1 wherein said combination plunger and double bellcrank assembly further comprises a top cover plate and a bottom cover plate and said left side bellcrank and said right side bellcrank are positioned between said respective cover plates and pivotally mounted therein by their own pivot pin.

* * * * *